US008253047B2

(12) United States Patent
Liu

(10) Patent No.: US 8,253,047 B2
(45) Date of Patent: Aug. 28, 2012

(54) KEYBOARD WITH REPLACEABLE KEYS

(75) Inventor: Man-Tian Liu, Shenzhen (CN)

(73) Assignees: Fu Tai Hua Industry (Shenzhen) Co., Ltd., ShenZhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 287 days.

(21) Appl. No.: 12/833,349

(22) Filed: Jul. 9, 2010

(65) Prior Publication Data

US 2011/0303517 A1 Dec. 15, 2011

(30) Foreign Application Priority Data

Jun. 11, 2010 (CN) ..... 2010 1 0197838

(51) Int. Cl.
*H01H 9/26* (2006.01)

(52) U.S. Cl. ..... 200/5 A

(58) Field of Classification Search ..... 200/5 A, 200/345, 329, 341, 512, 314
See application file for complete search history.

(56) References Cited

U.S. PATENT DOCUMENTS 4,551,717 A * 11/1985 Dreher ..... 345/170
5,867,149 A * 2/1999 Jaeger ..... 345/172
7,964,810 B2 * 6/2011 Keist et al. ..... 200/264

* cited by examiner

*Primary Examiner* — Edwin A. Leon
(74) *Attorney, Agent, or Firm* — Altis Law Group, Inc.

(57) ABSTRACT

A keyboard includes a plurality of keys. Each key includes a base, a key cap detachably connected to the base and includes at least two conductors, a flexible element connected between the key cap and the base, and a plurality of conduct lines mounted on the base. The conduct lines are not contacting each other. One end of each conduct line is connected to a processing unit. Each conduct line is assigned a code. If the key cap of one key is pressed, the conductors of the key contacts the conduct lines, thereby creating an electrical connection between the two conduct lines, and generating an electrical signal. The processing unit determines the function of the key according to the codes of the connected conduct lines.

14 Claims, 4 Drawing Sheets

KEYBOARD WITH REPLACEABLE KEYS

BACKGROUND

1. Technical Field

The present disclosure relates to a keyboard with replaceable keys.

2. Description of Related Art

Keys with different functions of a commonly used keyboard are arrayed in permanent positions on the keyboard. The keys cannot be arrayed according to personal preference or habit. Therefore, before using the keyboard, the user must remember the array of the buttons, resulting in low work efficiency.

BRIEF DESCRIPTION OF THE DRAWINGS

The components of the drawings are not necessarily drawn to scale, the emphasis instead being placed upon clearly illustrating the principles of the keyboard. Moreover, in the drawings, like reference numerals designate corresponding parts throughout several views.

DETAILED DESCRIPTION

Figure 1:
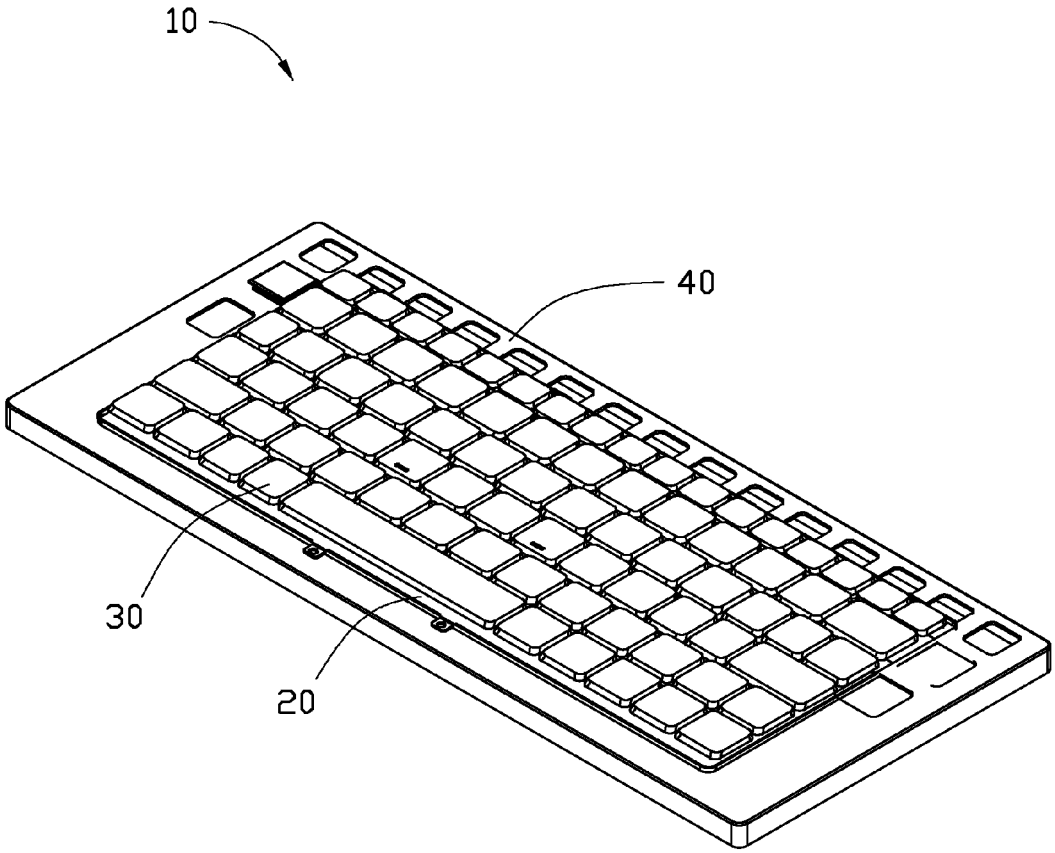
FIG. 1 is an isometric diagram of a keyboard in accordance with one embodiment.

Referring to FIG. 1, a keyboard 10 in accordance with one embodiment includes a key area 20. A plurality of keys 30 are arrayed on the key area 20.

Figure 2:
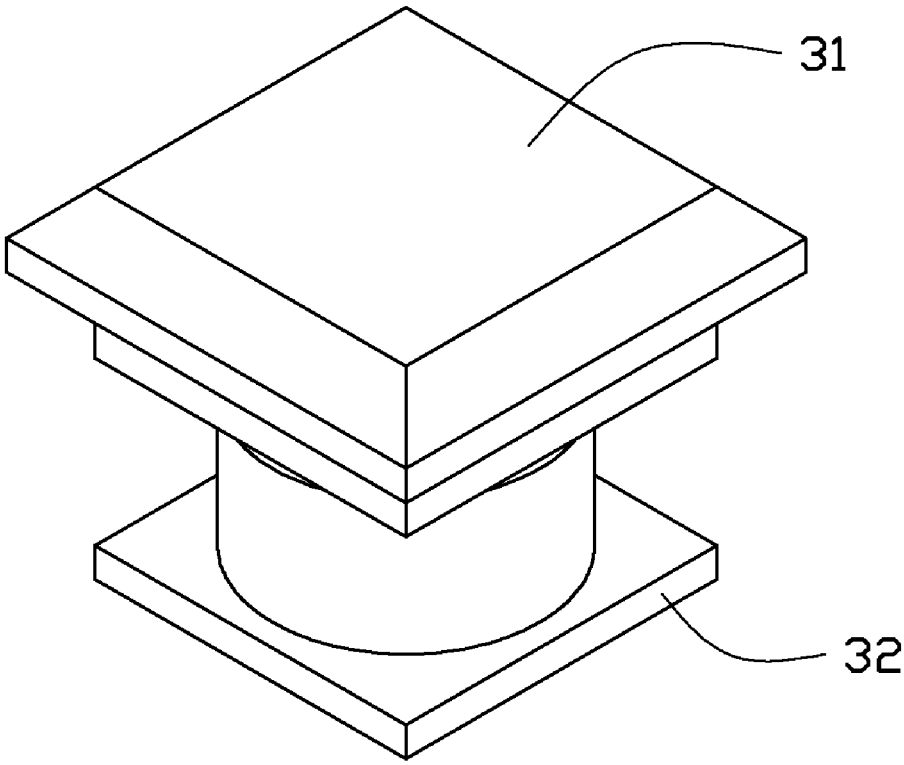
FIG. 2 is an isometric diagram of one key of the keyboard in FIG. 1.
Figure 3:
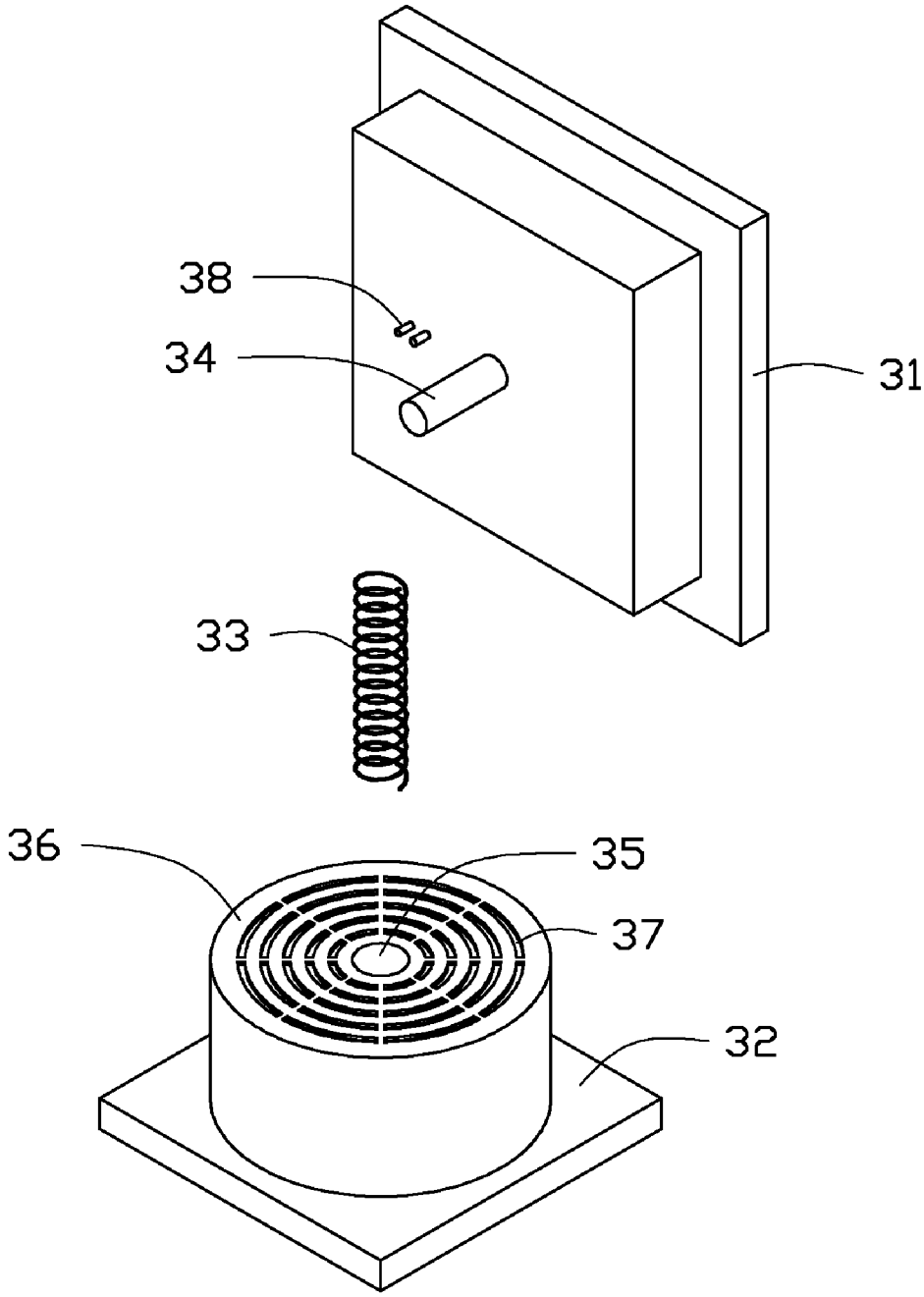
FIG. 3 is an exploded diagram of the key in FIG. 2.

In this embodiment, one key 30 is taken for example to describe the keys 30 of the keyboard 10. Referring to FIGS. 2 and 3, each key 30 includes a key cap 31, a base 32, and a flexible element 33. The key cap 31 is detachably connected to the base 32. A pole 34 is fixed to the key cap 31. A hole 35 is defined on a top surface 36 of the base 32. One end of the flexible element 33 is received in the hole 35 and fixed to the base 32. The pole 34 is first inserted into the flexible element 33 and then it received in the hole 35, thereby connecting the key cap 31 to the base 32. In the illustrated embodiment, the flexible element 33 is a spring.

At least two conduct lines 37 are mounted on the base 32. The conduct lines 37 are not contacting each other. One end of each conduct line 37 is connected to a processing unit (not shown). Each conduct line 37 is assigned a code. The function of each key 30 can be predetermined by the codes of every two conduct lines 37.

Two conductors 38 are fixed to the key cap 31. After the key cap 31 is mounted to the base 32, if the key cap 31 of the keys 30 is pressed, the two conductors 38 contact two of the conduct lines 37 respectively, thereby creating an electrical connection between the two conduct lines 37 and generating an electrical signal. The processing unit determines the function of the key 30 according to the codes of the two connected conduct lines 37. Because different buttons 30 have different functions, the conduct lines 37 connected by the two conductors 38 of different buttons 30 are also different. Therefore, the position of the two conductors 38 on the key cap 31 of each key 30 determines the function.

Figure 4:
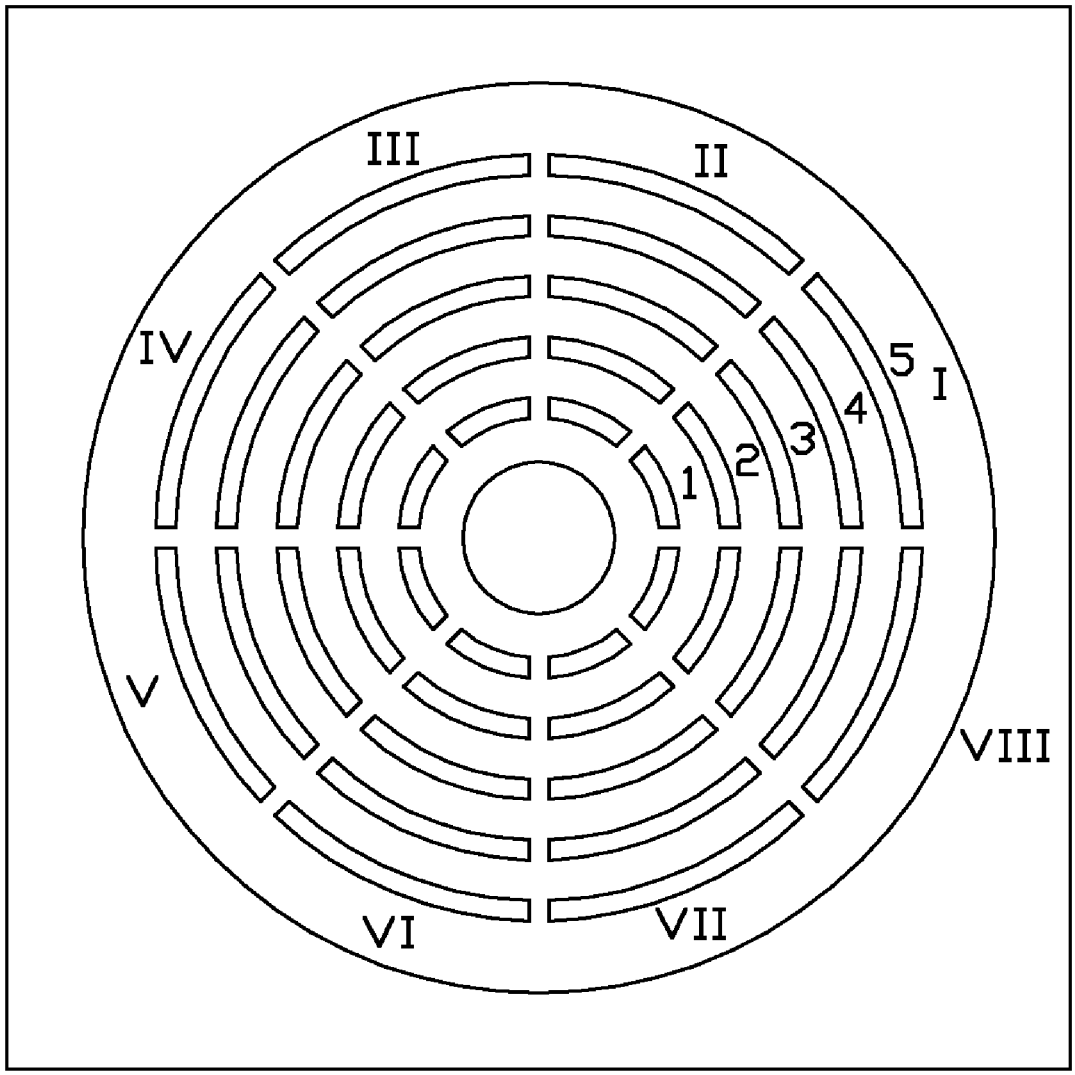
FIG. 4 is a schematic diagram of a distribution of conduct lines on a top surface of a base of the key in FIG. 2.

In this embodiment, the code of each conduct line 37 is assigned according to the array of the conduct lines 37 on the top surface 36 of the base 32. As shown in FIG. 4, the top surface 36 of the base 32 is divided into eight sections, namely I section, II section, III section, IV section, V section, VI section, VII section, and VIII section. The conduct lines 37 are distributed at the top surface 36 in ring-shapes at a plurality of layers. Therefore, the code of each conduct line 37 is assigned according to the section and the layer which the conduct line 37 arrays on the top surface 36 of the base 32, such as I section 1 layer, I section 2 layer, I section 3 layer, I section 4 layer, I section 5 layer, II section 1 layer, II section 2 layer, and so on. Further, a function is predetermined for every two lines 37 that can be connected by the two conductors 38. For example, character A input is predetermined for the connection of conduct lines 37 of I section 1 layer and I section 2 layer, character B input is predetermined for the connection of conduct lines 37 of II section 1 layer and II section 2 layer. Inferring from the above description, the function of each key 30 has no relation with the position in which the key 30 is arrayed on the keyboard 10. Therefore, the keys 30 on the keyboard can be arrayed according to a user's preference or habit.

The keyboard 10 can further include a free area 40. If there are some keys 30 that are unused in real operation, the unused keys 30 can be detached to be placed in the free area 40.

Although the present disclosure has been specifically described on the basis of preferred embodiments, the disclosure is not to be construed as being limited thereto. Various changes or modifications may be made to the embodiment without departing from the scope and spirit of the disclosure.

What is claimed is:

1. A keyboard, comprising a plurality of keys, each key comprising a base, a key cap detachably connected to the base and comprising at least two conductors, a flexible element connected between the key cap and the base, and a plurality of conduct lines mounted on the base, wherein the conduct lines are not contacting each other, one end of each conduct line is connected to a processing unit, and each conduct line is assigned a code; if the key cap of one key is pressed, the at least two conductors of the key contact at least two of the conduct lines, creating an electrical connection between the two conduct lines, and generating an electrical signal, wherein the processing unit determines the function of the key according to the codes of the connected conduct lines.

2. The keyboard as described in claim 1, wherein the position of each key cap is determined by two conduct lines connected by two conductors.

3. The keyboard as described in claim 1, wherein the base has a top surface divided into a plurality of sections and a plurality of layers, and the at least two conduct lines are mounted on a top surface of the base and distributed in different sections and different layers.

4. The keyboard as described in claim 3, wherein the code is assigned for each of the at least two conduct lines according to the section and layer in which the conduct lines are distributed on the top surface of the base.

5. The keyboard as described in claim 1, further comprising a pole fixed to the key cap, wherein a hole is defined on a top surface of the base, one end of the flexible element is received in the hole and fixed to the base, the pole is inserted into the flexible element and received in the hole, thereby connecting the key cap to the base.

6. The keyboard as described in claim 1, wherein the flexible element is a spring.

7. The keyboard as described in claim 5, wherein the flexible element is a spring.

8. The keyboard as described in claim 1, further comprising a free area for placing key caps detached from the keys.

9. A key, comprising a base, a key cap detachably connected to the base and comprising at least two conductors, a flexible element connected between the key cap and the base, and a plurality of conduct lines mounted on the base, wherein the conduct lines are not contacting each other, one end of each conduct line is connected to a processing unit, and each conduct line is assigned a code; if the key cap of one key is pressed, the at least two conductors of the key contact at least two of the conduct lines, creating an electrical connection between the two conduct lines, and generating an electrical signal, wherein the processing unit determines the function of the key according to the codes of the connected conduct lines.

10. The key as described in claim 9, wherein the base has a top surface divided into a plurality of sections and a plurality of layers, and the at least two conduct lines are mounted on a top surface of the base and distributed in different sections and different layers.

11. The key as described in claim 10, wherein the code is assigned for each of the at least two conduct lines according to the section and layer in which the conduct lines are distributed on the top surface of the base.

12. The key as described in claim 9, further comprising a pole fixed to the key cap, wherein a hole is defined on a top surface of the base, one end of the flexible element is received in the hole and fixed to the base, the pole is inserted into the flexible element and received in the hole, thereby connecting the key cap to the base.

13. The key as described in claim 9, wherein the flexible element is a spring.

14. The key as described in claim 12, wherein the flexible element is a spring.

* * * * *